US010483647B2

(12) United States Patent
Chien

(10) Patent No.: US 10,483,647 B2
(45) Date of Patent: Nov. 19, 2019

(54) ANTENNA DEVICE

(71) Applicant: GEMTEK TECHNOLOGY CO., LTD., Hsinchu County (TW)

(72) Inventor: Hsiao-Ching Chien, Hsinchu County (TW)

(73) Assignee: GEMTEK TECHNOLOGY CO., LTD., Hsinchu County (TW)

( * ) Notice: Subject to any disclaimer, the term of this patent is extended or adjusted under 35 U.S.C. 154(b) by 0 days.

(21) Appl. No.: 15/992,211

(22) Filed: May 30, 2018

(65) Prior Publication Data

US 2019/0006765 A1 Jan. 3, 2019

Related U.S. Application Data

(60) Provisional application No. 62/527,045, filed on Jun. 30, 2017.

(30) Foreign Application Priority Data

Feb. 13, 2018 (TW) ..... 107202321 U

(51) Int. Cl.
*H01Q 13/10* (2006.01)
*H01Q 19/18* (2006.01)
*H01Q 5/28* (2015.01)

(52) U.S. Cl.
CPC ..... *H01Q 13/10* (2013.01); *H01Q 5/28* (2015.01); *H01Q 19/18* (2013.01)

(58) Field of Classification Search
CPC ..... H01Q 13/10; H01Q 19/18; H01Q 5/28; H01Q 1/521; H01Q 1/007; H01Q 1/2291; H01Q 15/14; H01Q 21/24; H01Q 21/28; H01Q 25/005
See application file for complete search history.

(56) References Cited

U.S. PATENT DOCUMENTS 5,124,733 A * 6/1992 Haneishi ..... H01Q 5/378 343/700 MS
6,995,709 B2 * 2/2006 Spittler ..... H01Q 9/0414 343/700 MS
2007/0188386 A1 * 8/2007 Cheng ..... H01Q 9/40 343/700 MS
2009/0058731 A1 * 3/2009 Geary ..... H01Q 9/0414 343/700 MS
2014/0002305 A1 * 1/2014 Hsu ..... H01Q 1/245 342/368

FOREIGN PATENT DOCUMENTS

CN 104577320 A 4/2015
TW I 292640 B 1/2008

* cited by examiner

*Primary Examiner* — Hoang V Nguyen
(74) *Attorney, Agent, or Firm* — CKC & Partners Co., LLC

(57) ABSTRACT

An antenna device is disclosed. The antenna device includes a first radiator, a second radiator, and a first reflection board. The first radiator is configured to radiate a first radio wave comprising a first wavelength value. The second radiator is configured to radiate a second radio wave comprising a second wavelength value. The first reflection board is located between the first radiator and the second radiator. A first ratio between the first wavelength value and a length value of the first reflection board is less than 0.5, and a second ratio between the second wavelength value and the length value of the first reflection board is greater than 0.5.

10 Claims, 4 Drawing Sheets

200B

200A

ANTENNA DEVICE

RELATED APPLICATIONS

This application claims priority to U.S. Provisional Application Ser. No. 62/527,045, filed Jun. 30, 2017 and Taiwan Application Serial Number 107202321, filed Feb. 13, 2018, which are herein incorporated by reference.

FIELD OF INVENTION

The invention relates to an antenna device. More particularly, the invention relates to an antenna device with multiband.

BACKGROUND

In the conventional configuration of the antenna device, the antenna field pattern of different frequency bands will point in different directions. For example, the low frequency antenna pointing forwards and the high frequency antenna pointing backwards; or the low frequency antenna transmits to the side and the high frequency antenna transmits to the front. If it is expected that the antenna field patterns of different frequency bands point in the same direction, the configuration of the conventional antenna device will require a larger antenna volume so that the antenna field patterns of different frequency bands point in the same direction.

Therefore, how to design a directional antenna with multiple frequency bands (at least two frequency bands) in a small space size and control the main beam of the antenna field pattern in different frequency bands to point in the same direction is one of the problems to be improved in the field.

SUMMARY

An embodiment of this disclosure is to provide an antenna device. The antenna device includes a first radiator, a second radiator, and a first reflection board. The first radiator is configured to radiate a first radio wave comprising a first wavelength value. The second radiator is configured to radiate a second radio wave comprising a second wavelength value. The first reflection board is located between the first radiator and the second radiator. A first ratio between the first wavelength value and a length value of the first reflection board is less than 0.5, and a second ratio between the second wavelength value and the length value of the first reflection board is greater than 0.5.

The embodiment of the present disclosure is to provide an antenna device. Utilizing the characteristics of the antenna reflection board and the frequency, in the case of a small antenna volume, the main beam of the antenna field patterns of different frequency bands is controlled to be in the same direction by adjusting the length value of the reflection board located between the first radiator and the second radiator.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
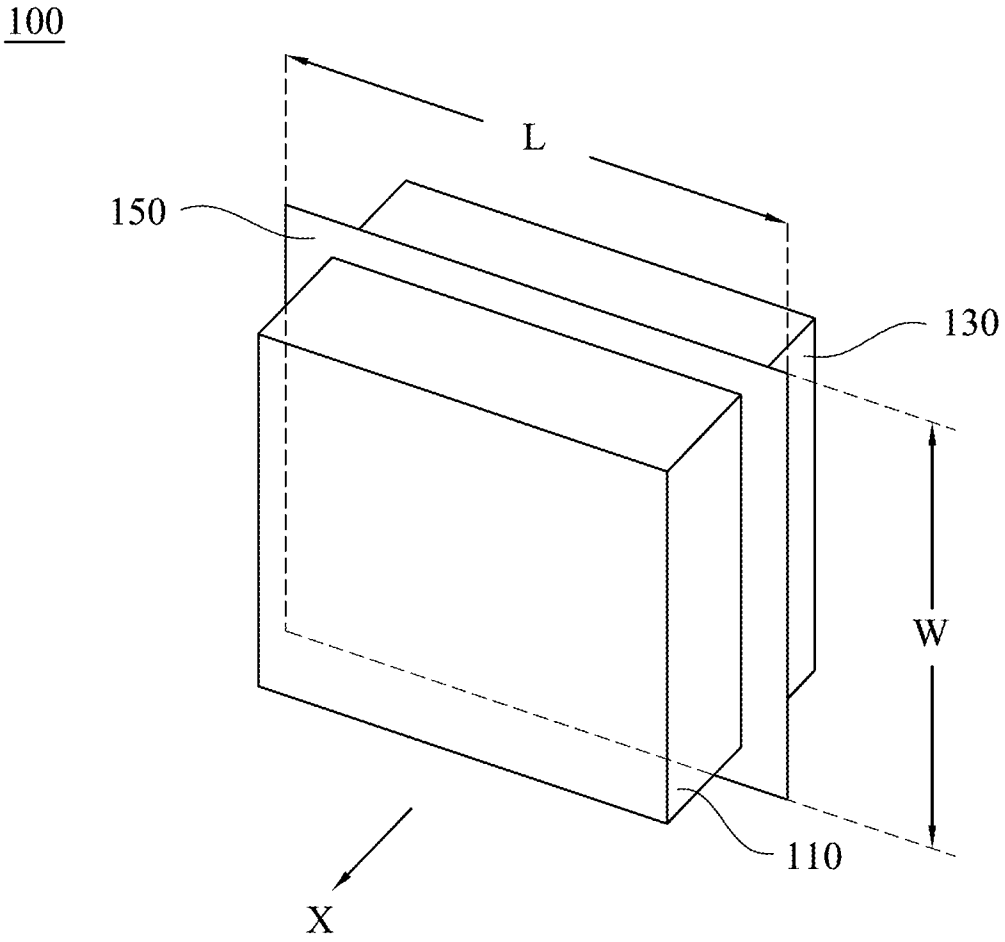
FIG. 1 is a schematic diagram illustrating an antenna device according to some embodiments of the present disclosure.

The following disclosure provides many different embodiments, or examples, for implementing different features of the invention. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention.

Reference is made to FIG. 1. FIG. 1 is a schematic diagram illustrating an antenna device 100 according to some embodiments of the present disclosure. As illustrated in FIG. 1, antenna device 100 includes a first radiator 130, a second radiator 110, and a first reflection board 150. In some embodiments, the first radiator 130 is a low frequency radiator, and the second radiator 110 is a high frequency radiator.

In the configuration relationship, as illustrated in FIG. 1. In some embodiments, the first reflection board 150 is located between the first radiator 130 and the second radiator 110. A plane of the first radiator 130, a plane of the first reflection board 150 and a plane of the second radiator 110 are partially overlapped in the X direction, and the plane of the first radiator 130, the plane of the first reflection board 150, and the plane of the second radiator 110 are perpendicular to the X direction respectively.

In the operation relationship, the first radiator 130 is configured to radiate a first radio wave including a first wavelength value $\lambda 1$, the second radiator 110 is configured to radiate a second radio wave including a second wavelength value $\lambda 2$. The first ratio n1 between the first wavelength value $\lambda 1$ and the length value L of the first reflection board 150 is less than 0.5, and second ratio n2 between the second wavelength value $\lambda 2$ and the length value L of the first reflection board 150 is greater than 0.5.

Since the first ratio n1 between the first wavelength value $\lambda 1$ and the length value L of the first reflection board 150 is less than 0.5, the antenna field pattern of the first radiator 130 may point to the X direction. Furthermore, since the second ratio n2 between the second wavelength value $\lambda 2$ and the length value L of the first reflection board 150 is greater than 0.5, the antenna field pattern of the second radiator 110 may also point to the X direction. That is, in the embodiments of the present disclosure, the antenna field patterns of the first radiator 130 and the second radiator 110 both point to the X direction.

Furthermore, since in the embodiments of the present disclosure, the antenna field patterns of the first radiator 130 and the second radiator 110 may be controlled to be both pointing to the X direction in the situation that a plane of the first radiator 130, a plane of the first reflection board 150, and a plane of the second radiator 110 are partially overlapped in the X direction. The embodiment of the present disclosure may achieve a smaller volume than the conventional antenna configuration method.

The relationship between the first wavelength value λ1, the first ratio n1, the second wavelength value λ2, the second ratio n2 and the length value L of the first reflection board 150 as mentioned above may be described by the following formula:

$$L=n1\times\lambda1=n2\times\lambda2.$$

That is, the ratio between the first wavelength value λ1 and the second wavelength value λ2 is equal to the ration between the second ratio n2 and the first ratio n1. In some embodiments, the ratio between the second wavelength value λ2 and the first wavelength value λ1 is 2. The embodiments of the present disclosure are not limited thereto.

In some embodiments, the first radio wave of the first radiator 130 includes a first wavelength value range, and the second radio wave of the second radiator 110 includes a second wavelength value range. The ratio between the smallest wavelength value of the first wavelength value range and the largest wavelength value of the second wavelength value range is equal to the ratio between the second ratio n2 and the first ratio n1.

For example, the first wavelength value range may be from 333 mm to 428 mm, that is, the corresponding first frequency value range may be from 700 Mhz to 900 Mhz. The second wavelength value range may be from 111 mm to 166 mm, that is, the corresponding second frequency value range may be from 1800 Mhz to 2700 Mhz. In the wavelength value range as mentioned above, the smallest wavelength value of the first wavelength value range may be 333 mm, and the largest wavelength value of the second wavelength value range may be 166 mm. In the situation, the length value L of the first reflection board 150 may be designed to be 133 mm. At this time, the first ratio n1 is 0.4, and the second ratio n2 is 0.8. Since the first ratio n1 is less than 0.5 and the second ratio n2 is greater than 0.5, in the design of the embodiments as mentioned above, the antenna field patterns of the first radiator 130 and the second radiator 110 may be achieved to be both pointing to the X direction.

Furthermore, in some embodiments, the width value W of the first reflection board 150 is not greater than the length value L of the first reflection board 150.

Figure 2B:
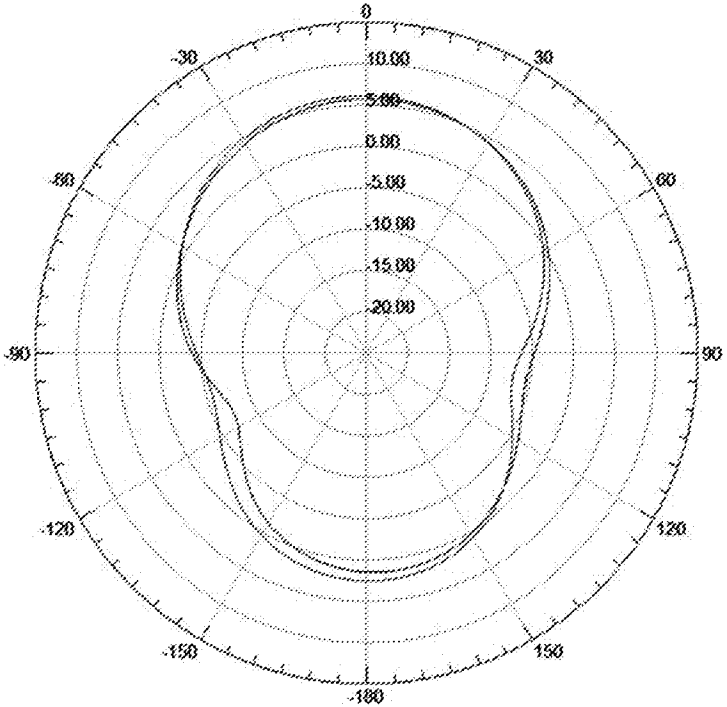
FIG. 2B is an experimental data chart illustrating an experimental data of an antenna device according to some embodiments of the present disclosure.
Figure 2A:
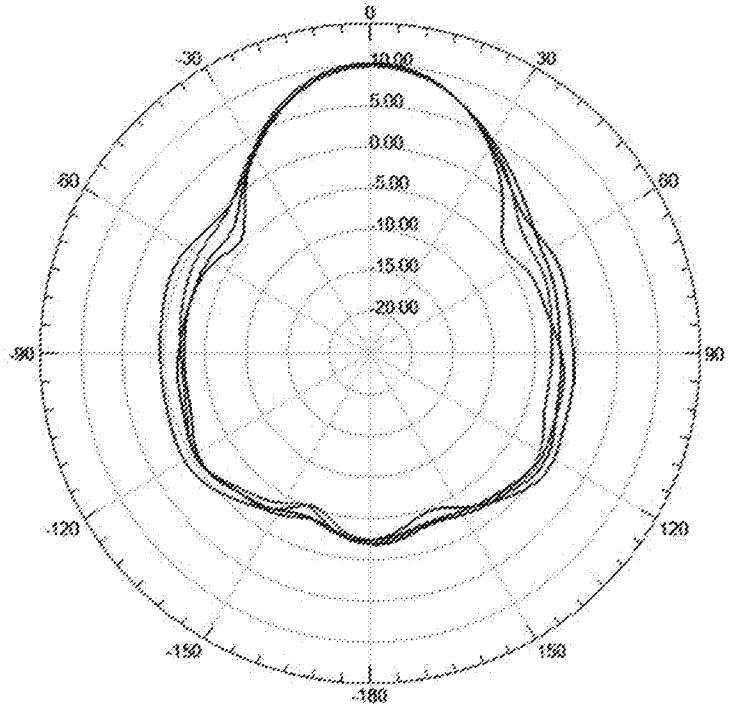
FIG. 2A is an experimental data chart illustrating an experimental data of an antenna device according to some embodiments of the present disclosure.

Reference is made to FIG. 2A and FIG. 2B. FIG. 2A is an experimental data chart 200A illustrating an experimental data of an antenna device 100 according to some embodiments of the present disclosure. FIG. 2B is an experimental data chart 200B illustrating an experimental data of an antenna device 100 according to some embodiments of the present disclosure. FIG. 2A is a field pattern of the second radiator 110, and FIG. 2B is a field pattern of the first radiator 130. It may be known from FIG. 2A and FIG. 2B, in the embodiments of the present disclosure, the first radiator 130 and the second radiator 110 both have the strongest radiation value in the 0 degree direction. That is, the field patterns of the first radiator 130 and the second radiator 110 both point to the 0 degree direction. That is, in the embodiments of the present disclosure, the field patterns of the first radiator 130 and the second radiator 110 may be achieved to be pointing to the same direction.

Figure 3:
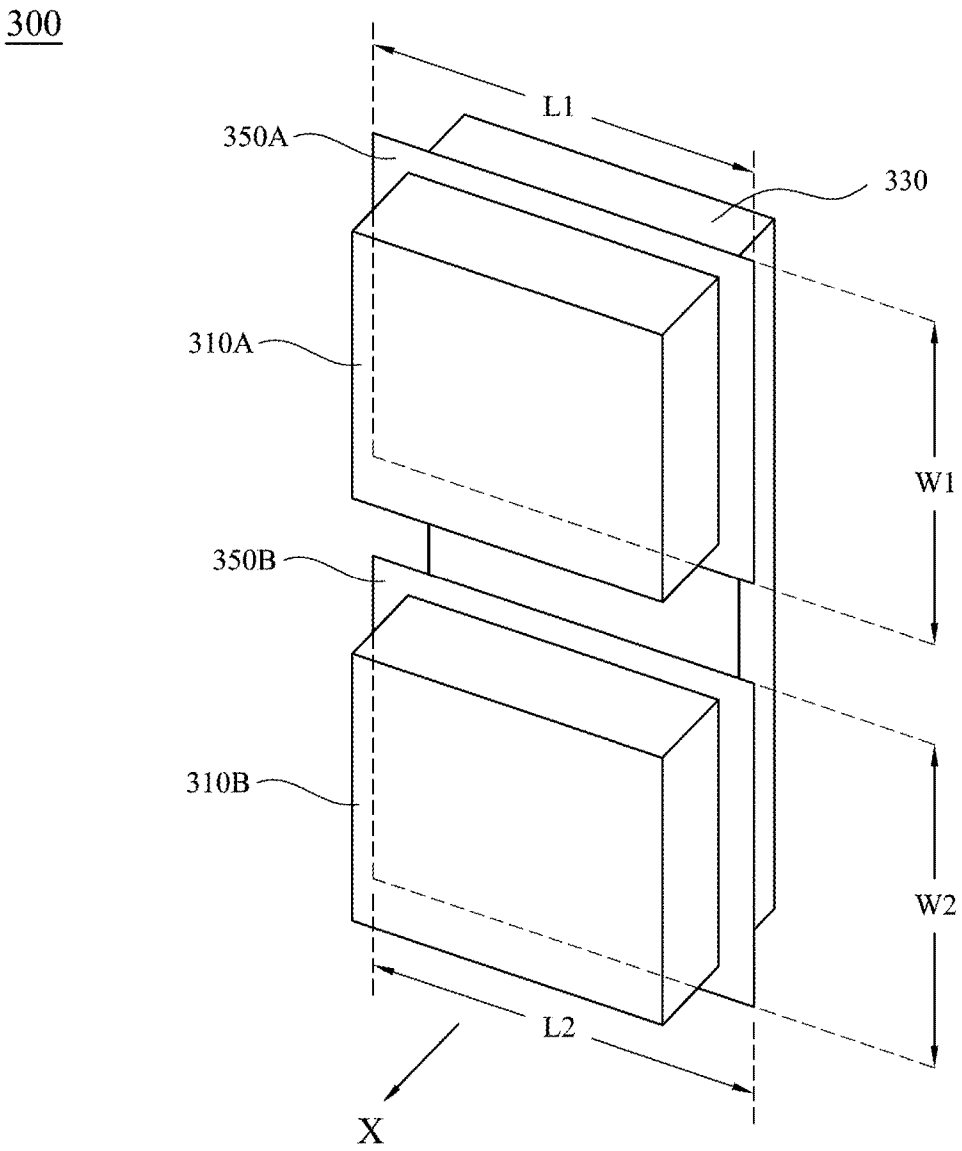
FIG. 3 is a schematic diagram illustrating another antenna device according to some embodiments of the present disclosure.

Reference is made to FIG. 3. FIG. 3 is a schematic diagram illustrating another antenna device 300 according to some embodiments of the present disclosure. As illustrated in FIG. 3, antenna device 300 includes a first radiator 330, a second radiator 310A, a third radiator 310B, a first reflection board 350A, and a second reflection board 350B. In some embodiments, the first radiator 330 is a low frequency radiator, and the second radiator 310A and the third radiator 310B are high frequency radiators.

In the configuration relationship, as illustrated in FIG. 3. In some embodiments, the first reflection board 350A is located between the first radiator 330 and the second radiator 310A. The second reflection board 350B is located between the first radiator 330 and the third radiator 310B. The plane of the second radiator 310A, the plane of the first reflection board 350A, and the plane of the first radiator 330 are partially overlapped in the X direction, and the plane of the second radiator 310A, the plane of the first reflection board 350A, and the plane of the first radiator 330 are perpendicular to the X direction respectively. The plane of the third radiator 310B, the plane of the second reflection board 350B, and the plane of the first radiator 330 are partially overlapped in the X direction, and the plane of the third radiator 310, the plane of the second reflection board 350B, and the plane of the first radiator 330 are perpendicular to the X direction respectively.

Furthermore, in some embodiments, the plane of the third radiator 310B and the plane of the second radiator 310A are not overlapped in the X direction, and the plane of the first reflection board 350A and the plane of the second reflection board 350B are not overlapped in the X direction.

In the operation relationship, the first radiator 330 is configured to radiate a first radio wave including a first wavelength value λ1. The second radiator 310A and the third radiator 310B are configured to radiate a second radio wave including the second wavelength value λ2. The first ratio n1 between the first wavelength value λ1 and the length value L1 of the first reflection board 350A is less than 0.5, and the second ratio n2 between the second wavelength value λ2 and the length value L1 of the first reflection board 350A is greater than 0.5. Furthermore, the first ratio n1 between the first wavelength value λ1 and the length value L2 of the second reflection board 350B is also less than 0.5, and the second ratio n2 between the second wavelength value λ2 and the length value L2 of the second reflection board 350B is also greater than 0.5.

Since the first ratio n1 between the first wavelength value λ1 and the length value L1 of the first reflection board 350A is less than 0.5, and the first ratio n1 between the first wavelength value λ1 and the length value L2 of the second reflection board 350B is less than 0.5, the antenna field pattern of the first radiator 330 may be pointing to the X direction. Furthermore, since the second ratio n2 between the second wavelength value λ2 and the length value L1 of the first reflection board 350A is greater than 0.5, and the second ratio n2 between the second wavelength value λ2 and the length value L2 of the second reflection board 350B is greater than 0.5, the antenna field patterns of the second radiator 310A and the third radiator 310B may both point to the X direction. That is, in the embodiments of the present disclosure, the antenna field patterns of the first radiator 330, the second radiator 310A and the third radiator 310B may all point to the X direction.

Furthermore, in some embodiments, the width value W1 of the first reflection board 350A is not greater than the length value L1 of the first reflection board 350A, and the width value W2 of the second reflection board 350B is not greater than the length value L2 of the second reflection board 350B.

Figure 4:
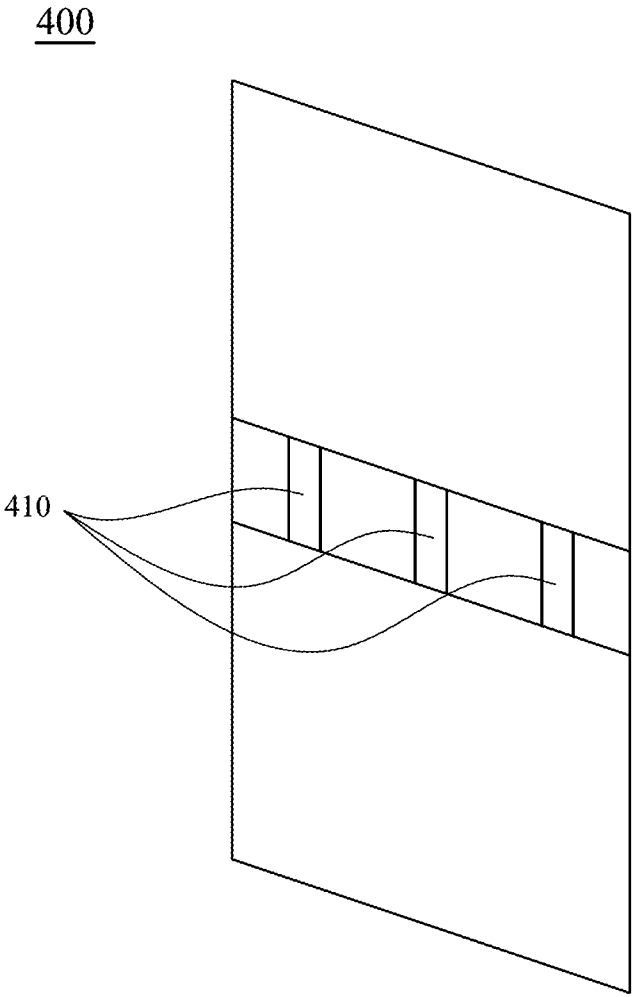
FIG. 4 is a schematic diagram illustrating a reflection board according to some embodiments of the present disclosure.

Reference is made to FIG. 4. FIG. 4 is a schematic diagram illustrating a reflection board 400 according to some embodiments of the present disclosure. The reflection board 400 as illustrated in FIG. 4 may be used to represent the first reflection board 150 in FIG. 1 and the first reflection board 350A and the second reflection board 350B in FIG. 3. As illustrated in FIG. 4, in some embodiments, the reflection board 400 includes at least one slot 410.

In some embodiments, the first radiator 130, 330, the second radiator 110, 310A, and the third radiator 310B may be dual polarized antennas. In some embodiments, the first radiator 130, 330, the second radiator 110, 310A and the third radiator 310B may be patch antennas, dipole antennas, slot antennas, spiral antennas or monopole antennas.

In some embodiments, the antenna device 100, 300 may be integrated in electronic devices with wireless communication capabilities, for example, an access point (AP), a personal computer (PC) or a laptop, but the present disclosure is not limited thereto. Any electronic device capable of supporting multi-input multi-output (MIMO) communication technology and having a communication function is within the scope protected by the present disclosure.

According to the embodiment of the present disclosure, it is understood that the embodiment of the present disclosure is to provide an antenna device. The antenna device utilize the characteristics of the antenna reflection board and the frequency, in the situation of a small antenna volume, the main beam of the antenna field patterns of different frequency bands is controlled to be in the same direction by adjusting the length value of the reflection board located between the first radiator and the second radiator.

In this document, the term "coupled" may also be termed as "electrically coupled", and the term "connected" may be termed as "electrically connected". "Coupled" and "connected" may also be used to indicate that two or more elements cooperate or interact with each other. It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments. As used herein, the term "and/or" includes any and all combinations of one or more of the associated listed items.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An antenna device, comprising:

a first radiator, configured to radiate a first radio wave comprising a first wavelength value;

a second radiator, configured to radiate a second radio wave comprising a second wavelength value; and a first reflection board, located between the first radiator and the second radiator;

wherein a first ratio between the first wavelength value and a length value of the first reflection board is less than 0.5, and a second ratio between the second wavelength value and the length value of the first reflection board is greater than 0.5;

wherein a main beam corresponding to the first wavelength value and a main beam corresponding to the second wavelength value points in the same direction.

2. The antenna device of claim 1, wherein a plane of the first radiator, a plane of the first reflection board, and a plane of the second radiator are partially overlapped in a first direction, and the plane of the first radiator, the plane of the first reflection board, and the plane of the second radiator are perpendicular to the first direction respectively.

3. The antenna device of claim 1, wherein a ratio between the first wavelength value and the second wavelength value is equal to a ratio between the second ratio and the first ratio.

4. The antenna device of claim 3, wherein the ratio between the first wavelength value and the second wavelength value is 2.

5. The antenna device of claim 1, wherein the first radio wave comprises a first wavelength value range, the second radio wave comprises a second wavelength value range, and the first wavelength value range comprises a smallest wavelength value, the second wavelength value range comprises a largest wavelength value;

wherein a ratio between the smallest wavelength value and the largest wavelength value is equal to a ratio between the second ratio and the first ratio.

6. The antenna device of claim 1, wherein the first reflection board comprises at least one slot.

7. The antenna device of claim 1, wherein the first radiator and the second radiator both comprise a dual polarized antenna.

8. The antenna device of claim 1, further comprising:

a third radiator, configured to radiate a third radio wave comprising the second wavelength value;

a second reflection board, located between the third radiator and the first radiator;

wherein a first ratio between the first wavelength value and a length value of the second reflection board is less than 0.5, and a second ratio between the second wavelength value and a length value of the second reflection board is greater than 0.5.

9. The antenna device of claim 8, wherein a plane of the third radiator, a plane of the second reflection board, and a plane of the first radiator are partially overlapped in a first direction, and the plane of the third radiator, the plane of the second reflection board and the plane of the first radiator are perpendicular to the first direction respectively.

10. The antenna device of claim 9, wherein the plane of the third radiator and the plane of the second radiator are not overlapped in the first direction, and a plane of the first reflection board and the plane of the second reflection board are not overlapped in the first direction.

* * * * *